US005239733A

United States Patent [19]

Vail, III et al.

[11] Patent Number: 5,239,733

[45] Date of Patent: Aug. 31, 1993

[54] TEMPORALLY DEGRADABLE URNS FOR BURIAL OF HUMAN CREMATION ASHES IN CEMETERIES

[76] Inventors: William B. Vail, III, 3123 198th Pl. SE., Bothell, Wash. 98012; Thomas E. Vail, Jr., 138 Taylor Blvd., Walsenburg, Colo. 81089

[21] Appl. No.: 778,493

[22] Filed: Oct. 17, 1991

[51] Int. Cl.[5] ..... A61G 17/08

[52] U.S. Cl. ..... 27/1

[58] Field of Search ..... 27/1, 2, 35; 47/74

[56] References Cited

U.S. PATENT DOCUMENTS 3,732,602 5/1973 Vigh ..... 27/1

*Primary Examiner*—Carl D. Friedman
*Assistant Examiner*—Kien Nguyen

[57] ABSTRACT

Articles of manufacture are described called temporally degradable urns which are chemically and/or biologically degradable urns for the initial deposit of ashes following the cremation of human remains are described. Each temporally degradable urn is designed to degrade within a predetermined period of time following burial in the earth. Cemeteries comprised of one or more temporally degradable urns placed into the earth are described. Methods of operation of cemeteries for such temporally degradable urns are described which prescribe as little initial ecological disturbance as possible. After the predetermined period of time, the buried urns completely chemically and/or biologically disintegrate, therefore returning the land its previous ecological condition. Thereafter, that land becomes suitable for the preservation of flora and fauna. Such methods of operation of urn cemeteries can be used as the critical methodology for the routine and ongoing preservation of entire ecosystems.

3 Claims, 1 Drawing Sheet

TEMPORALLY DEGRADABLE URNS FOR BURIAL OF HUMAN CREMATION ASHES IN CEMETERIES

BACKGROUND OF THE INVENTION

1. Field of the Invention

The field of invention relates to an article of manufacture that is an urn used for the containment of human cremation ashes which is buried into the earth that is designed to disintegrate within prescribed periods of time in the particular location of earth chosen. Such an article of manufacture is defined as a temporally degradable urn. The field of invention further relates to a composition of matter comprised of one or more temporally degradable urns placed into the earth to form a cemetery wherein said temporally degradable urns are designed to disintegrate within prescribed periods of time within that particular cemetery. The field of invention further relates to a new use of said composition of matter which becomes a wildfire pressure after the urns within the particular cemetery have completely disintegrated in time. Applicable sections of U.S. Patent Classification include Class 27, Subclasses 1 and 2.

2. Description of the Prior Art

At the time of the filing of the application herein, the applicants are unaware of any prior art that is relevant to the invention.

SUMMARY OF THE INVENTION

This application concerns solving two seeming disparate problems. Finding adequate cemetery space in the United States is becoming progressively more difficult and costly in time. As another seemingly independent problem, preserving land indefinitely for ecological preserves for flora and fauna is also becoming progressively more difficult and costly in time.

Articles of manufacture, compositions of matter, and uses for the compositions are disclosed herein which allow using predetermined portions of land for the above two different purposes. Initially, the predetermined portions of land are operated as cemeteries. After some predetermined period of time, the predetermined portions of land become used exclusively and solely as wildlife preserves.

Articles of manufacture which are chemically and/or biologically degradable urns for the initial deposit of ashes following the cremation of human remains are described. These articles of manufacture are designed to degrade within a predetermined period of time following burial in the earth. Methods of operation of cemeteries for such temporally degradable urns are described which prescribe as little initial ecological disturbance as possible. After the predetermined period of time, the buried urns completely chemically and/or biologically disintegrate, therefore returning the land to its previous ecological condition. Thereafter, that land becomes suitable for the preservation of flora and fauna.

Accordingly, an object of the invention is to provide new articles of manufacture that are urns used for the deposit of ashes following human cremations which upon displacement into the earth decompose in predetermined and predictable periods of time within particular localities that are defined to be temporally degradable urns.

Accordingly, another object of the invention is to provide a composition of matter comprised of one or more temporally degradable urns placed into the earth to form a cemetery wherein said temporally degradable urns are designed to disintegrate within prescribed periods of time within that particular cemetery.

It is yet another object of the invention to provide new uses of the new compositions of matter which become wildlife preserves after the urns within the cemeteries have completely disintegrated in time.

DESCRIPTION OF THE PREFERRED EMBODIMENTS

Figure 1:
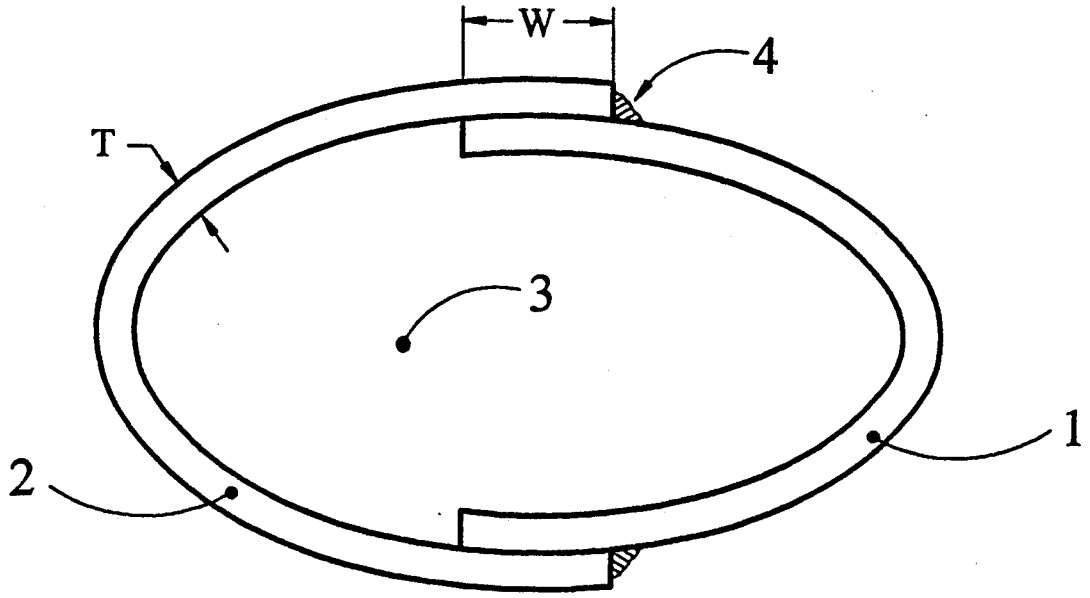
FIG. 1 describes an article of manufacture defined as a temporally degradable urn for burial of human cremation ashes in cemeteries.

FIG. 1 is a section view of one preferred embodiment of an article of manufacture of the invention. One-half of an ellipsoidal cavity of revolution 1 is designed to slide into an interior portion of another one-half ellipsoidal cavity of revolution 2 as shown in FIG. 1. The cavities overlap by width W. The wall thickness is T, being the same for both cavities. The material comprising the wall thickness T is chemically and/or biologically degradable in a predetermined period of time for a given cemetery location. The cavity volume 3 is to be filled with ashes from cremation prior to the joining of the two ellipsoidal cavities of revolution. Joining material 4 mechanically joins the two ellipsoidal cavities of revolution for suitable burial in the cemetery for the temporally degradable urns.

In a preferred embodiment, the ellipsoidal cavities are made from iron. In this case, the joining material would be conveniently a weld, which may be water-proof. In a particular cemetery having a certain average rainfall, a certain average temperature, and known soil chemistry, a particular wall thickness T can be chosen to degrade in a particular time. For example, in a particular location within the state of Colorado, weather conditions might provide for the total disintegration of a wall thickness of 0.030 inches thick of iron, and the associated weld, within the following time period: no sooner than 60 years (TS) and no later than 100 years (TL), with the average expected decomposition time being 80 years (TA).

Following burial, in general the urn will not decompose sooner than a time TS, nor later than a time TL, with the average decomposition time being defined as TA. Analysis from the field of chemical engineering will determine these times for a particular cemetery location using knowledge of at least the following: the typical weather conditions providing average moisture present in the soil and the average soil temperature; detailed chemical analysis of the soil; and experiments on the decomposition of materials at specific localities. Experience in given localities will also serve as a guide for determining the above time intervals.

The urns may be made of different materials, different thicknesses, and different joining materials. For example, in another preferred embodiment, the urns may be fabricated from compressed wood which would biodegrade within predetermined period of time. In such a preferred embodiment, biodegradable glue would be used as the joining material.

Therefore, articles of manufacture have been described which are urns which disintegrate in predetermined time periods within particular cemeteries. Such articles are defined as temporally degradable urns. One or more of such temporally degradable urns can be placed into the earth at any one location to form a cemetery wherein said temporally degradable urns are designed to disintegrate within prescribed periods of time within that particular cemetery. The fact that the urns disintegrate within prescribed periods of time provides a composition of matter (the cemetery) that returns to its natural state within those prescribed periods of time. The invention therefore provides uses of the new compositions of matter which become wildlife preserves after the urns within the cemeteries have completely disintegrated in time. The definition of "completely disintegrated in time" is subject to standard statistical analysis of the type typically used in the engineering and measurement arts. Methods of operation of the cemeteries for such urns, including methods of business operation of such cemeteries, are now described which allow the cemeteries to be used for the preservation of flora, fauna, and of ecological systems.

Cemeteries exist partially because of the requirements of the living relatives and acquaintances. Such people have a need to visit the marked gravesite of the deceased. Typically, there is such a need for a predetermined period of time, perhaps 80 years. In such a case, the cremation ashes would be interred in an urn which decomposes within a particular predetermined cemetery within an average time TA of 80 years. During an initial period of operation, the urn cemetery could be operated on either a non-profit basis or as a for-profit cemetery. Thereafter, following the disintegration of the urns, the cemetery would automatically convert into ecological preserves for wildlife.

A particular hypothetical example is recited below which describes certain temporally degradable urns, certain methods of operation of the cemeteries for the urns, and certain methods of business operations which provide for conversion of the urn cemeteries into ecological preserves after the particular time period of 100 years.

The location for the urn cemetery in this example is currently privately held land near the San Isabel National Forest adjacent to a proposed wilderness area. This land is now in a wild-state, and is worth preserving indefinitely into the future for the varied wildlife, plant life, and for its ecological significance in general. This land would be purchased from its current owners by a corporate entity, and such land to be preserved is an example of an "Ecological Trust Property". This particular Ecological Trust Property also has an ideal mountain view suitable for desirability as an urn cemetery location. The Ecological Trust Property would be operated as a normal cemetery for approximately 100 years.

Each urn would be buried in a given gravesite on a minimum of 1 acre plots in the Ecological Trust Property. Here, there is to be 1 acre per each gravesite. Each gravesite is to be plotted in detail on a map for location by relatives during the first 100 years. A temporally degradable urn is to be buried in each gravesite with as little disturbance to the adjacent ecology as possible. Each gravesite is to be marked solely with a 12 inch by 12 inch marker head-stone that is flush with the earth. It is anticipated that the entire cemetery, or this particular Ecological Trust Property, would become filled within 20 years. All urns would disintegrate within 80 years. At the end of 100 years, all the marker-head stones would be collected into a very small portion on the Ecological Trust Property for future historical records.

After a total time span of 100 years, the particular Ecological Trust Property would be formally transferred to the Ecological Trust Foundation. By that time, the land would show absolutely no signs of having been used as an urn cemetery. The sole purpose of the Ecological Trust Foundation is to preserve the natural states and ecological significance of the various Ecological Trust Properties donated to that foundation over time. Of course, a major purpose for the temporally degradable urn is so that the land would return to its wild state after the disintegration of the urn itself. After the decomposition of the urn, the land becomes suitable for ecological preservation.

The decomposition of such urns may also be of importance in the legal field which would allow the legal conversion of the urn cemeteries into wildlife preserves. Such conversion of urn cemeteries into wildlife preserves may also involve the initial explicit written permission of those individuals to be interred into the urn cemeteries. The invention provides a new composition of matter comprised of the combination of temporally degradable urns containing cremated human ashes and their burial on land initially used as an urn cemetery that is to be ecologically preserved into the future. This new composition of matter provides the new and surprising result of allowing the preservation of ecologically significant lands into the future.

The temporally degradable urns and the cemeteries disclosed herein satisfy the needs of human burial services which also have the surprising potential to preserve large portions of ecosystems indefinitely into the future. By paying for burial in the Ecological Trust Property, the individual creates a living legacy into the future not achievable by other methods. For example, by purchasing a given property, an individual cannot guarantee burial on it, nor can an individual guarantee that such land will not change hands for other uses. The temporally degradable urns, and the method of burial of the urns in such an Ecological Trust Property does provide a guarantee to an individual of such a living legacy of ecologically preserved land into the future. In this particular manner, an individual's death may in fact provide an eternal living legacy into the future.

What is claimed is:

1. A degradable urn for burial of cremated remains comprising:
   - a pair of semi-ellipsoidal cavities being telescopically engaged one within the other, said cavities being made of a biodegradable material; said pair of semi-ellipsoidal cavities having a predetermined wall thickness; and
   - joining means which mechanically joins said pair of semi-ellipsoidal cavities together.

2. A method of making a degradable urn for burial of cremated remains comprising the steps of:
   - forming a pair of semi-ellipsoidal cavities, having a predetermined wall thickness, out of a biodegradable material;
   - fitting one of said semi-ellipsoidal cavities within the other of said semi-ellipsoidal cavities; and
   - mechanically joining the semi-ellipsoidal cavities together with joining means.

3. A method of using a degradable urn for burial of cremated remains comprising the steps of:
   - placing a plurality of degradable urns into a tract of land; said urns being formed of a pair of semi-ellipsoidal cavities, having a predetermined wall thickness, comprised of a biodegradable material;
   - allowing the urns to decay over a period of time; and
   - converting said tract of land into an ecologically viable tract such as a wildlife refuge park.

* * * * *